United States Patent [19]

Mori

[11] Patent Number: 4,617,879

[45] Date of Patent: Oct. 21, 1986

[54] FUEL AND OIL MIXTURE PRODUCING DEVICE FOR TWO-CYCLE ENGINES

[75] Inventor: Atsushi Mori, Iwata, Japan

[73] Assignee: Sanshin Kogyo Kabushiki Kaisha, Hamamatsu, Japan

[21] Appl. No.: 660,747

[22] Filed: Oct. 15, 1984

[30] Foreign Application Priority Data

Oct. 24, 1983 [JP] Japan ..... 58-197660

[51] Int. Cl.[4] ..... F02B 33/04

[52] U.S. Cl. ..... 123/73 AD

[58] Field of Search ..... 123/73 AD

[56] References Cited

U.S. PATENT DOCUMENTS

| | | | |
|---|---|---|---|
| 963,322 | 7/1910 | Purdy | 137/98 |
| 2,986,162 | 5/1961 | Spexarth | 137/571 |
| 3,168,904 | 2/1965 | Conover | 137/558 |
| 4,262,710 | 4/1981 | Nomura et al. | 123/73 AD |
| 4,381,741 | 5/1983 | Walsworth | 123/73 AD |
| 4,388,896 | 6/1983 | Sheridan et al. | 123/73 AD |
| 4,402,351 | 9/1983 | Momura et al. | 123/73 AD |
| 4,403,578 | 9/1983 | Iwai et al. | 123/73 AD |
| 4,471,727 | 9/1984 | Odashima | 123/73 AD |

OTHER PUBLICATIONS

Sales Catalog Page-Electronic Gas/Oil Metering for Apr. 1980-1982, OMC V-4, V-6 and OMC Sea Drive-TM Economixer.

*Primary Examiner*—Magdalen Y. C. Greenlief
*Attorney, Agent, or Firm*—Ernest A. Beutler

[57] ABSTRACT

A fuel/lubricant supply system for a two-cycle engine having a tank that is divided by an internal wall into a lubricant reservoir portion and fuel reservoir portion. An arrangement is provided for transferring a metered amount of lubricant from the lubricant reservoir portion into the fuel reservoir portion in response to the signal transmitted from a sensing device that senses the amount of fuel added to the fuel reservoir portion.

9 Claims, 3 Drawing Figures

FUEL AND OIL MIXTURE PRODUCING DEVICE FOR TWO-CYCLE ENGINES

BACKGROUND OF THE INVENTION

This invention relates to a fuel and oil mixture producing device for two-cycle engines and more particularly to an improved reservoir for the fuel and lubricant of such an engine that insures the proper fuel lubricant ratio in response to the amount of fuel added to the fuel portion of the reservoir.

One of the disadvantages with two-cycle engines of the type that is lubricated by a fuel lubricant mixture is the necessity to measure the amount of lubricant added to the fuel in the fuel tank so as to insure the proper fuel lubricant ratio. When the fuel system is used in conjunction with an outboard motor, it is particularly disadvantageous since the fuel tank may be positioned in the associated watercraft and the mixing must, at times, take place within the boat itself. Although devices have been proposed for automatically mixing lubricant with the fuel, the previously proposed devices have not been automatic in operation and, furthermore, have not been accurate regardless of the amount of fuel that is added to the fuel portion of the reservoir.

It is, therefore, a principal object of this invention to provide an improved fuel and oil mixture producing device for two-cycle engines.

It is another object of this invention to provide an improved system for automatically adding lubricant to fuel in proportion to the amount of fuel that is added to the fuel reservoir.

It is a still further object of this invention to provide an improved fuel lubricant reservoir in which the lubricant is automatically transferred to the fuel portion of the reservoir in response to the amount of fuel that is added.

SUMMARY OF THE INVENTION

This invention is adapted to be embodied in a fuel and lubricant supply system for two-cycle engines or the like and comprises a fuel reservoir and a lubricant reservoir. Means are provided for sensing the amount of fuel supplied to the fuel reservoir and means automatically transfer a measured portion of lubricant from the lubricant reservoir to the fuel reservoir in response to the amount of fuel added to the fuel reservoir as sensed by the sensing means.

DETAILED DESCRIPTION OF THE PREFERRED EMBODIMENT

Figure 1:
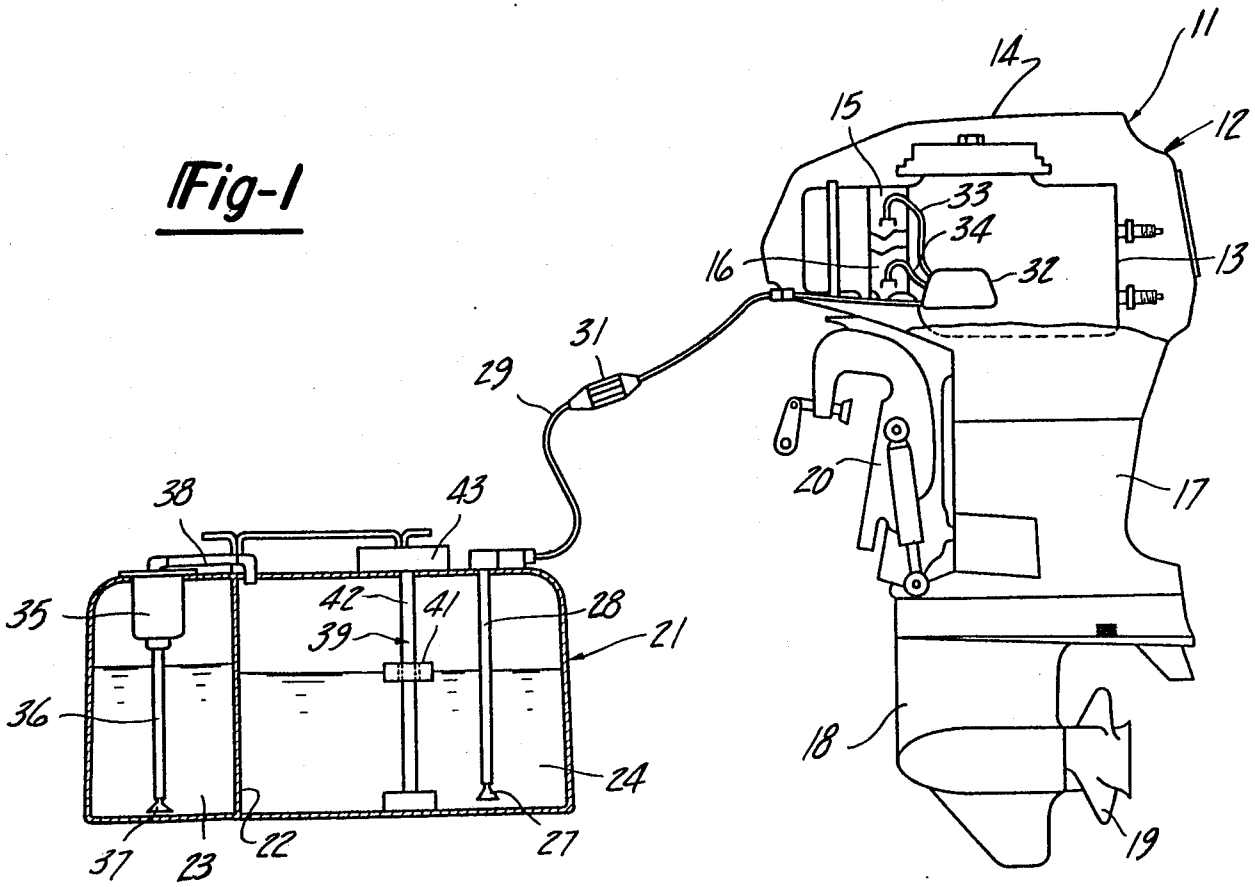
FIG. 1 is a side elevational view of an outboard motor and its fuel and lubricant reservoir constructed in accordance with the invention, with portions broken away.
Figure 2:
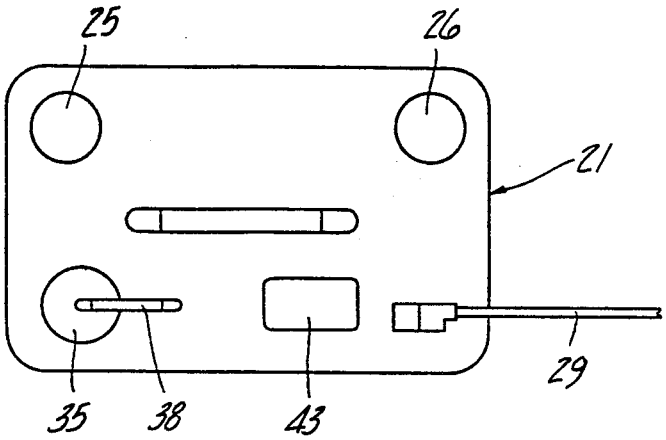
FIG. 2 is a top plan view of the fuel, lubricant reservoir.
Figure 3:
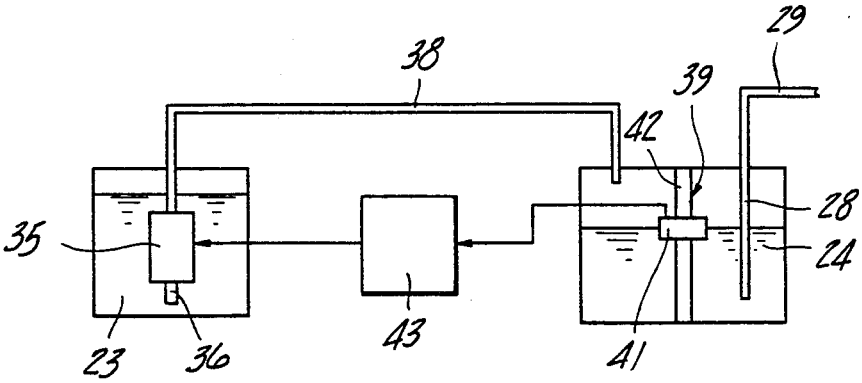
FIG. 3 is a schematic view showing the system.

In the drawings, the reference numeral 11 indicates generally an outboard motor having a fuel/lubricant system constructed in accordance with an embodiment of the invention. Although the invention is described in conjunction with an outboard motor, it is to be understood that certain features of it may be employed in connection with other two-cyle engine applications. The motor 11 inclues a power head, indicated generally by the reference numeral 12 and including an internal combustion engine operated on the two-stroke, crankcase compression cycle 13 and surrounding protective cowling 14. The engine 13 is, in the illustrated embodiment, of the two cylinder, in-like type and has a pair of crankcase chambers, one for each cylinder, each of which is supplied with a fuel/lubricant/air mixture by a respective carburetor 15, 16. It is to be understood, however, that the invention is capable of use with engines having different types of induction systems and different charge forming devices such as fuel injection units as well as engines having different numbers of cylinders.

A drive shaft housing 17 depends from the power head 12 and contains a drive shaft (not shown) that is driven by the engine 13. In turn, a lower unit 18 is positioned beneath the drive shaft housing 17 and contains a propeller 19 and transmission mechanism for driving the propeller 19 in a suitable manner.

A clamping swivel bracket assembly 20 is connected to the drive shaft housing 17 and affords a means for detachably connecting the motor 11 to the hull or transom of an associated watercraft (not shown). As is well known, the clamping swivel bracket assembly 21 includes an arrangement for permitting tilting movement of the outboard motor 11 about a horizontally extending axis and steering movement about a verticaly extending axis.

In accordance with the invention, a combined fuel/-lubricant reservoir, indicated generally by the reference numeral 21, is adapted to be remotely positioned from the outboard motor 11 and within the hull of the associated watercraft. The internal cavity of the reservoir 21 is divided by a generally vertically extending wall 22 into a lubricant reservoir portion 23 and a fuel reservoir portion 24. A fill cap 25 is provided for permitting the operator to replenish the lubricant reservoir portion 23. In a similar manner, a fill cap 26 is provided for permitting the operator to replenish the fuel in the fuel reservoir portion 24. In accordance with the invention, an arrangement to be described is provided for transferring a predetermined amount of lubricant from the lubricant reservoir portion 23 to the fuel reservoir portions 24 in response to the amount of fuel which is added to the fuel reservoir portion 24.

The fuel/lubricant mixture is drawn from the fuel reservoir portion 24 through a strainer type inlet 27 and inlet line 28. The inlet line 28 cooperates with a fuel conduit 29 in which a manually operated priming 31 is provided. The conduit 29 and priming pump 31 supply the fuel/lubricant mixture to a fuel pump 32 which is mounted on the side of the engine 13 and which may be driven in any appropriate manner. The fuel pump 32 delivers fuel to the fuel bowls of the carburetors 15 and 16 through respective supply lines 33 and 34.

A lubricant pump 35 is positioned within the lubricant reservoir 23 and, in accordance with a preferred form of the invention, is electrically driven from a suitable control, as will become apparent. An intake pipe 36 depends from the lubricant pump 35 and has an inlet strainer 37 at its lower end so as to pick up lubricant from the reservoir 23. This lubricant is transferred, in metered quantities, through a supply line 38 to the fuel reservoir 24.

Contained within the fuel reservoir 24 is a measuring device, indicated generally by the reference numeral 39, which is adapted to send a signal indicating the amount of fuel present in the reservoir 24. This device may comprise a float 41 that is slidably supported on a post 42 and which cooperates with the post so as to act as a variable resistor to provide a signal indicative of the height of the float 41 and, accordingly, the amount of fuel in the fuel reservoir 24.

The fuel sensing device 39 provides its output signal to a microprocessor 43. The microprocessor 43 is operative to control the lubricant pump 35 so as to operate the lubricant pump 35 for a predetermined period of time depending upon the amount of fuel added by the operator to the fuel reservoir 24. The way that this is done is that the sensing device 39 provides a signal to the microprocessor 43 which indicates the level of fuel in the reservoir 25 and this value is retained in a memory. When fuel is added and the float level 41 raises, the microprocessor 43 will compute the amount of fuel that has been added and the amount of lubricant necessary to provide the proper lubricant/fuel mixture. The pump 35 will then be operated for an appropriate period of time to transfer the lubricant from the lubricant reservoir 23 into the fuel reservoir 24. Fuel/lubricant mixture will be delivered at the proper ratio to the fuel pump 32 and, hence, to the carburetors 15 and 16. Thus, it should be readily apparent that the arrangement is operative to provide the necessary fuel/lubricant ratio regardless of the amount of fuel that is added to the reservoir 24. That is, the amount of fuel added need not be measured by the operator since the device itself will measure the amount of fuel added and transfer the appropriate amount of lubricant into the fuel reservoir 24.

Although an embodiment of the invention has been illustrated and described, various changes and modifications may be made, without departing from the sprit and scope of the invention, as defined by the appended claims.

I claim:

1. A fuel/lubricant supply system for a two-cycle engine or the like comprising a fuel reservoir, a lubricant reservoir, measuring means for measuring the amount of fuel supplied to said fuel reservoir, and metering means for transferring an amount of lubricant from said lubricant reservoir to said fuel reservoir in proportion to the amount of fuel added to the fuel reservoir as measured by said measuring means.

2. A fuel/lubricant supply system as set forth in claim 1 wherein the metering means for transferring the lubricant from the lubricant reservoir to the fuel reservoir comprises a lubricant pump driven for a time determined by the measured amount of fuel added.

3. A fuel/lubricant suppy system as set forth in claim 1 wherein the fuel reservoir and lubricant reservoir are formed within a common container.

4. A fuel/lubricant supply system as set forth in claim 3 wherein the metering means for transferring the measured portion of lubricant from the lubricant reservoir to the fuel reservoir comprises a lubricant pump contained within the lubricant reservoir and driven for a time determined by the measured amount of fuel added.

5. A fuel/lubricant supply system as set forth in claim 4 wherein the measuring means comprises a fuel level device.

6. A fuel/lubricant supply system as set forth in claim 5 wherein the fuel level device is provided within the fuel reservoir.

7. A fuel/lubricant supply system as set forth in claim 1 wherein the measuring means comprises a fuel level device.

8. A fuel/lubricant supply system as set forth in claim 7 wherein the fuel level device is provided within the fuel reservoir.

9. A combined fuel/lubricant supply reservoir for a two-cycle engine or the like comprising a tank, wall means within said tank dividing said tank into a lubricant reservoir and a fuel reservoir, lubricant pump means contained within said lubricant reservoir, conduit means for connecting the output of said lubricant pump means into said fuel reservoir, measuring means for measuring the level of fuel in said fuel reservoir, and means responsive to the measuring of the addition of fuel to said fuel reservoir for operating said lubricant pump for a predetermined period of time for transferring a predetermined amount of lubricant to said fuel reservoir in proportion to the amount of fuel added thereto.

* * * * *